US011585197B2

(12) United States Patent
Mazrooee et al.

(10) Patent No.: US 11,585,197 B2
(45) Date of Patent: Feb. 21, 2023

(54) SPLIT FLOW PUMPING SYSTEM CONFIGURATION

(71) Applicant: Halliburton Energy Services, Inc., Houston, TX (US)

(72) Inventors: Mehdi Mazrooee, Double Oak, TX (US); Timothy Holiman Hunter, Duncan, OK (US); Stanley V. Stephenson, Duncan, OK (US); Mark A. Adams, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 211 days.

(21) Appl. No.: 17/285,602

(22) PCT Filed: Nov. 21, 2018

(86) PCT No.: PCT/US2018/062255
§ 371 (c)(1),
(2) Date: Apr. 15, 2021

(87) PCT Pub. No.: WO2020/106290
PCT Pub. Date: May 28, 2020

(65) Prior Publication Data

US 2021/0396114 A1 Dec. 23, 2021

(51) Int. Cl.
*E21B 43/30* (2006.01)
*E21B 43/26* (2006.01)
(Continued)

(52) U.S. Cl.
CPC ..... *E21B 43/26* (2013.01); *F04B 49/06* (2013.01); *F04C 11/00* (2013.01); *F04C 14/02* (2013.01);
(Continued)

(58) Field of Classification Search
CPC ..... E21B 43/30
See application file for complete search history.

(56) References Cited

U.S. PATENT DOCUMENTS 7,343,974 B2 3/2008 Cowan
7,841,394 B2 11/2010 McNeel et al.
(Continued)

OTHER PUBLICATIONS

International Search Report and Written Opinion issued in related PCT Application No. PCT/US2018/062255 dated Aug. 20, 2019, 13 pages.
(Continued)

*Primary Examiner* — Kenneth L Thompson
(74) *Attorney, Agent, or Firm* — Conley Rose, P.C.; Rodney B. Carroll

(57) ABSTRACT

The present disclosure relates generally to well operations. The present disclosure relates more particularly to a systems and methods for independently and/or simultaneously treating multiple wells from a centralized location using a split flow pumping system configuration. The split flow pumping system configuration may comprise one or more blenders, one or more boost pumps, a pumping system comprising one or more pumps, a component storage system, and a fluid storage system for treatment of two or more wells using two or more treatment compositions. The split flow pumping system configuration may comprise one or more controllers for controlling the one or more blenders, the one or more boost pumps, the pumping system comprising one or more pumps, the component storage system, and the fluid storage system. The system may comprise one or more sensors for collecting data corresponding to the one or more pressures, flow rates, injection rates, compositions, temperatures, and densities of at least one of the first composition and the second composition, wherein the controller controls the one or more pressures, flow rates, injection rates, compositions,
(Continued)

temperatures, and densities of at least one of the first composition and the second composition based, at least in part, on the data.

20 Claims, 3 Drawing Sheets

(51) Int. Cl.

| | |
|---|---|
| ***F04B 49/06*** | (2006.01) |
| ***F04C 11/00*** | (2006.01) |
| ***F04C 14/02*** | (2006.01) |
| ***F04D 13/12*** | (2006.01) |
| ***F04D 15/02*** | (2006.01) |

(52) U.S. Cl.
CPC ..... *F04D 13/12* (2013.01); *F04D 15/0209* (2013.01)

(56) References Cited

U.S. PATENT DOCUMENTS

| | | | | |
|---|---|---|---|---|
| 7,946,340 | B2 * | 5/2011 | Surjaatmadja | E21B 43/267 166/308.1 |
| 8,056,635 | B2 | 11/2011 | Shampine et al. | |
| 8,146,665 | B2 | 4/2012 | Neal | |
| 8,336,631 | B2 | 12/2012 | Shampine et al. | |
| 8,590,614 | B2 | 11/2013 | Suijaatmadja et al. | |
| 8,851,186 | B2 | 10/2014 | Shampine et al. | |
| 9,016,383 | B2 | 4/2015 | Shampine et al. | |
| 9,127,545 | B2 | 9/2015 | Kajaria et al. | |
| 9,169,706 | B2 * | 10/2015 | Kellam, III | E21B 43/267 |
| 9,759,054 | B2 | 9/2017 | Gay et al. | |
| 9,896,923 | B2 * | 2/2018 | Lakhtychkin | E21B 43/267 |
| 9,903,190 | B2 | 2/2018 | Conrad et al. | |
| 11,098,568 | B2 * | 8/2021 | Bryant | E21B 43/267 |
| 11,439,966 | B2 * | 9/2022 | Dusterhoft | E21B 43/2607 |
| 2007/0125543 | A1 | 6/2007 | McNeel et al. | |
| 2007/0201305 | A1 | 8/2007 | Heilman et al. | |
| 2007/0277982 | A1 | 12/2007 | Shampine et al. | |
| 2009/0095482 | A1 | 4/2009 | Surjaatmadja | |
| 2009/0194273 | A1 * | 8/2009 | Surjaatmadja | E21B 43/30 166/250.1 |
| 2009/0277640 | A1 | 11/2009 | Thompson et al. | |
| 2010/0326663 | A1 | 12/2010 | Bobier et al. | |
| 2011/0067885 | A1 | 3/2011 | Shampine et al. | |
| 2012/0006550 | A1 | 1/2012 | Shampine et al. | |
| 2013/0098619 | A1 | 4/2013 | Shampine et al. | |
| 2014/0069651 | A1 | 3/2014 | Shampine et al. | |
| 2015/0204173 | A1 | 7/2015 | Shampine et al. | |
| 2017/0198548 | A1 * | 7/2017 | Dickinson | E21B 43/26 |
| 2022/0389800 | A1 * | 12/2022 | Warner | E21B 21/08 |

OTHER PUBLICATIONS

Foreign Communication from Related Application—Canada Office Action, Application No. CA 3,109,359, dated Nov. 21, 2022, 4 pages.

International Preliminary Report on Patentability issued in related PCT Application No. PCT/US2018/062255 dated Jun. 3, 2021, 9 pages.

* cited by examiner

SPLIT FLOW PUMPING SYSTEM CONFIGURATION

CROSS-REFERENCE TO RELATED APPLICATION

The present application is a U.S. National Stage Application of International Application No. PCT/US2018/062255 filed Nov. 21, 2018, which is incorporated herein by reference in its entirety for all purposes.

TECHNICAL FIELD

The present disclosure relates generally to well operations, and more particularly to a split flow pumping system configuration that enables the simultaneous treatment of multiple wells.

BACKGROUND

In the production of oil and gas in the field, it is often required to stimulate and treat multiple well locations within a designated amount of time. Stimulation and treatment processes often involve mobile equipment that is set up and put in place at a pad and then moved by truck from pad to pad within short time periods.

Traditionally, a fluid composition produced at the pad flows into a single well. In current configurations, multiple wells may be treated simultaneously, but only where each of the wells are treated with one fluid composition. Further, each of the wells receive the same treatment using the one fluid composition. For example, if multiple wells are simultaneously in treatment and one well sands out, such that treatment of that one well must cease, treatment of the other wells must similarly cease.

SUMMARY

Disclosed herein is a system comprising a component storage system comprising one or more components; a blending system that produces a first composition comprising the one or more components and a second composition comprising the one or more components; and a pumping system comprising a first one or more pumps, a second one or more pumps, a third one or more pumps, and a fourth one or more pumps, wherein the first composition is pumped to a first one or more wells by the first one or more pumps, wherein the first composition is pumped to a second one or more wells by the second one or more pumps, wherein the second composition is pumped to the first one or more wells by the third one or more pumps, and wherein the second composition is pumped to the second one or more wells by the fourth one or more pumps.

In one or more embodiments, the blending system may further comprise a first one or more blenders for producing the first composition and a second one or more blenders for producing the second composition.

In one or more embodiments, the system may further comprise one or more sensors for sensing one or more pressures, flow rates, injection rates, compositions, temperatures, and densities of at least one of the first composition and the second composition.

In one or more embodiments, the system may further comprise a controller for controlling one or more pressures, flow rates, injection rates, compositions, temperatures, and densities of at least one of the first composition and the second composition. In one or more embodiments, the system may further comprise one or more sensors for collecting data corresponding to the one or more pressures, flow rates, injection rates, compositions, temperatures, and densities of at least one of the first composition and the second composition, wherein the controller controls the one or more pressures, flow rates, injection rates, compositions, temperatures, and densities of at least one of the first composition and the second composition based, at least in part, on the data.

In one or more embodiments, the first composition may combine with the second composition to create a first treatment composition for treatment of the first one or more wells, and wherein the first composition combines with the second composition to create a second treatment composition for treatment of the second one or more wells. In one or more embodiments, the first treatment composition may be created at one or more of the surface of the first one or more wells and below ground level in the first one or more wells, and the second treatment composition may be created at one or more of the surface of the second one or more wells and below ground level in the second one or more wells. In one or more embodiments, the pumping system may simultaneously treat the first one or more wells with the first treatment composition and treat the second one or more wells with the second treatment composition. In one or more embodiments, at least one of the first composition has a different composition than the second composition and the first treatment composition has a different composition than the second treatment composition.

Disclosed herein is a system comprising a blending system for producing a first composition; a boost pump for pumping a second composition; and a pumping system comprising a first one or more pumps, a second one or more pumps, a third one or more pumps, and a fourth one or more pumps, wherein the first composition is pumped to a first one or more wells by the first one or more pumps, wherein the first composition is pumped to a second one or more wells by the second one or more pumps, wherein the second composition is pumped to the first one or more wells by the third one or more pumps, and wherein the second composition is pumped to the second one or more wells by the fourth one or more pumps.

In one or more embodiments, the system may further comprise one or more sensors for sensing one or more pressures, flow rates, injection rates, compositions, temperatures, and densities of at least one of the first composition and the second composition.

In one or more embodiments, the system may further comprise a controller for controlling one or more pressures, flow rates, injection rates, compositions, temperatures, and densities of at least one of the first composition and the second composition. In one or more embodiments, the system may further comprise one or more sensors for collecting data corresponding to the one or more pressures, flow rates, injection rates, compositions, temperatures, and densities of at least one of the first composition and the second composition and the controller may control the one or more pressures, flow rates, injection rates, compositions, temperatures, and densities of at least one of the first composition and the second composition based, at least in part, on the data.

In one or more embodiments, the first composition may combine with the second composition to create a first treatment composition for treatment of the first one or more wells, and the first composition may combine with the second composition to create a second treatment composition for treatment of the second one or more wells. In one or more embodiments, the first treatment composition may be created at one or more of the surface of the first one or more wells and below ground level in the first one or more wells, and the second treatment composition may be created at one or more of the surface of the second one or more wells and below ground level in the second one or more wells. In one or more embodiments, the pumping system may simultaneously treat the first one or more wells with the first treatment composition and treat the second one or more wells with the second treatment composition. In one or more embodiments, at least one of the first composition has a different composition than the second composition and the first treatment composition has a different composition than the second treatment composition.

Disclosed herein is a method for treating two or more wells comprising operating a first one or more pumps to pump a first composition; operating a second one or more pumps to pump the first composition; operating a third one or more pumps to pump a second composition; operating a fourth one or more pumps to pump the second composition; combining the first composition and the second composition to create a first treatment composition; combining the first composition and the second composition to create a second treatment composition; treating a first one or more wells with the first treatment composition; and treating a second one or more wells with the second treatment composition.

In one or more embodiments, the first treatment composition differs from the second treatment composition. In one or more embodiments, the method may further comprise modifying the composition of at least one of the first treatment composition and the second treatment composition by modifying operation of at least one of the first one or more pumps, the second one or more pumps, the third one or more pumps, and the fourth one or more pumps.

Figure 1:
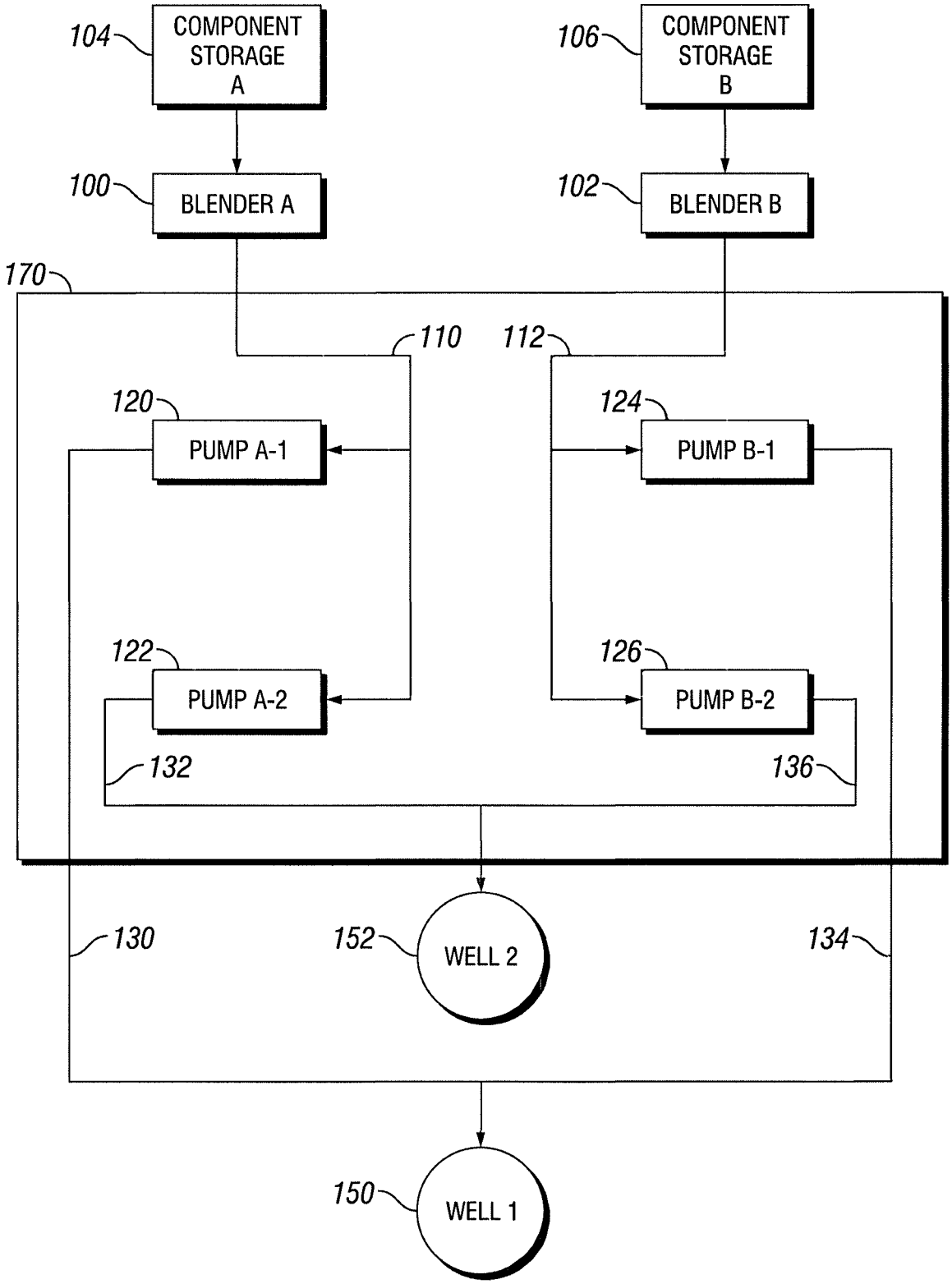
FIG. 1 illustrates a flow diagram of a centralized well treatment facility for treating multiple wells comprising a split flow pumping system configuration and multiple blenders.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only and are not exhaustive of the scope of the disclosure.

DETAILED DESCRIPTION OF EMBODIMENTS

The present disclosure relates generally to well operations. The present disclosure relates more particularly to a method and apparatuses for independently and/or simultaneously treating multiple wells from a centralized location using a split flow pumping system configuration. The present disclosure discloses one or more embodiments comprising a split flow pumping system configuration connected to two or more blenders. The present disclosure discloses one or more embodiments comprising a split flow pumping system configuration connected to one blender.

Illustrative embodiments of the present disclosure are described in detail herein. In the interest of clarity, not all features of an actual implementation may be described in this specification. It will be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of one or more embodiments are given. In no way should the following examples be read to limit, or define, the scope of the disclosure. Embodiments may be used both for onshore and offshore operations using existing or specialized equipment or a combination of both. Embodiments may be enclosed in a permanent, semi-permanent, or mobile structure. Embodiments described herein may be applicable to injection wells and production wells, including hydrocarbon wells, and may be applicable to acidizing, gravel packing, cementing, and other types of well treatment.

In one or more embodiments, a centralized well treatment operations facility may comprise a split flow pumping system. The split flow pumping system may comprise a power source, a component storage system, a fluid storage system, a blending system, and a pumping system comprising one or more pumps for delivering one or more treatment compositions to two or more wells for treatment of the two or more wells. Connections within and without of the well treatment operations facility may include conduit comprising standard piping or tubing known to one of ordinary skill in the art. The pumping system may comprise one or more pumps including without limitation positive displacement pumps, centrifugal pumps, and any other pumps for one or more of distributing fluid within the centralized well treatment facility and pumping one or more treatment compositions to two or more wells. In one or more embodiments, the pumping system may comprise one or more high pressure pumps, one or more low pressure pumps, and any combination thereof.

The blending system may comprise one or more blenders for producing one or more compositions. Those of ordinary skill in the art having the benefit of the present disclosure will appreciate that compositions produced by the blender may comprise one or more components, including without limitation one or more base fluids, one or more gasses, one or more liquids, one or more solids, and any combination thereof that may be used in accordance with the methods of the present disclosure. In an example embodiment, a composition may comprise one or more of water from any source, well-stimulation fluid, cement, gelling agents, breakers, surfactants, crosslinkers, gelling agents, viscosity altering chemicals, PH buffers, modifiers, surfactants, breakers, and stabilizers, as well as friction reducers, viscosifiers, diverting agents, and diverting material.

The split flow pumping system may produce one or more treatment compositions comprising one or more fluids and one or more compositions. Examples treatment compositions may be identified by a variety of identifying labels including without limitation drill-in fluids, drilling fluids, completion fluids, workover fluids, and fracturing fluids. In one or more embodiments, the treatment compositions of the present disclosure may include any fluid known in the art, including aqueous fluids, non-aqueous fluids, and any combinations thereof. The term fluid may refer to the major component of any fluid or composition (as opposed to components dissolved and/or suspended therein) and does not indicate any particular condition or property of a fluid such as its mass, amount, pH, etc. Examples of non-aqueous fluids that may be suitable for use in the methods and systems of the present disclosure include, but are not limited to, oils, hydrocarbons, organic liquids, and the like.

Fluids that may be suitable for use in the systems and methods of the present disclosure may include water from any source. Aqueous fluids may comprise fresh water, salt water (for example, water containing one or more salts dissolved therein), brine (for example, saturated salt water), seawater, and any combination thereof. In one or more embodiments, aqueous fluids may include one or more ionic species, such as those formed by salts dissolved in water. The ionic species may be any suitable ionic species known in the art. In one or more embodiments, the density of the aqueous fluid can be adjusted to, among other purposes, provide additional particulate transport and suspension. In one or more embodiments, the pH of the aqueous fluid may be adjusted (for example, by a buffer or other pH adjusting agent) to a specific level, which may depend on, among other factors, the types of clays, acids, and other additives included in the fluid. Fluid may be mixed with a gas, including without limitation nitrogen and carbon dioxide, wherein the gas may be mixed with the fluid while the gas is in one of liquid and gaseous states. One of ordinary skill in the art with the benefit of this disclosure will recognize when one or more of density, ionic state, pH level, and any other appropriate parameter needs be modified for a fluid or composition.

In one or more embodiments, compositions and treatment compositions may comprise one or more components and one or more fluids. Components may comprise one or more solids and one or more polymers. Solids may comprise any solid material including without limitation proppants, ceramics, and diverting materials. Polymers may comprise any natural and synthetic polymer (and combinations thereof) that is capable of modifying one or more of the viscosity, suspension, and filtration control of a fluid. Suitable polymers include without limitation guar, guar derivatives, cellulose, cellulose derivatives, biopolymers, starches, poly(styrene-butadiene), poly(styrene-acrylate), polyethylene, polypropylene, polyvinyl alcohol, polyvinylchloride, polylactic acid, polyacrylamide, polyvinylpyrrolidone, poly (2-acrylamido-2-methyl-1-propanesulfonic acid), polyacrylate, partially hydrolyzed polyacrylate, polyethylene glycol, polypropylene glycol and combinations thereof.

FIG. 1 illustrates a flow diagram of a centralized well treatment facility comprising a split flow pumping system configuration for treating multiple wells using multiple blenders. In one or more embodiments, a split flow pumping system configuration may comprise a blending system comprising blenders 100, 102, a component storage system comprising component storage A 104 and component storage B 106, a fluid storage system (not shown), a pumping system 170 for delivering one or more treatment compositions to wells 150, 152, and a power source (not shown). Blender 100 may produce a first composition, which conduit 110 may convey to pumps 120, 122. Conduit 130 may convey the first composition from pump 120 to well 150 and conduit 132 may convey the first composition from pump 122 to well 152. Similarly, blender 102 may produce a second composition and conduit 112 may convey the second composition to pumps 124, 126.

Conduit 134 may convey the second composition from pump 124 to well 150 and conduit 136 may convey the second composition from pump 126 to well 152. The first composition, in conduit 130, may combine with the second composition, in conduit 134, to create a first treatment composition for treatment of well 150 and the first composition, in conduit 132, may combine with the second composition, in conduit 136, to create a second treatment composition for treatment of well 152. In one or more embodiments, conduits 134, 136 may comprise a common suction header.

The split flow pumping system configuration of FIG. 1 enables individual treatment of multiple wells, i.e., wells 150, 152. For example, wells 150, 152 may be treated with similar treatment compositions, but may receive treatment compositions at different pressures, or treatment compositions at different flow rates. In another example, wells 150, 152 may be treated with different treatment compositions, for example, a first treatment composition is used to treat well 150 while a second treatment composition is used to treat well 152. In yet another example, well 150 may be treated with a treatment composition while well 152 is not undergoing treatment, or well 152 may be treated with a treatment composition while well 150 is not undergoing treatment.

The split flow pumping system configuration of FIG. 1 also enables simultaneous treatment of multiple wells, including wells 150, 152. For example, wells 150, 152 may be simultaneously treated with similar treatment compositions, but may receive different amounts of treatment composition or the treatment compositions may be delivered at different pressures. In another example, wells 150, 152 may be treated simultaneously with one or more of different treatment compositions, one or more treatment compositions at different pressures, and one or more treatment compositions delivered at different flow rates. In an example embodiment, pumps 120, 124 may discharge compositions at higher flow rates or at higher pressures than pumps 122, 126, such that well 150 and well 152 may be simultaneously treated but receive different treatment.

The configuration of FIG. 1 also enables dynamic variation of the one or more treatment compositions for treatment of wells 150, 152 without modifying the composition of compositions produced by blenders 100, 102. In one example, pumps 120, 124 may discharge compositions to well 150 and either or both of pumps 120, 124 may vary, for example, the flow rate or flow pressure to modify the treatment of well 150. Likewise, pumps 122, 126 may discharge compositions to well 152 and either or both of pumps 122, 126 may vary, for example, the flow rate or flow pressure to modify the treatment of well 152. Accordingly, treatment of well 150 is independent of well 152, and treatment of wells 150, 152 may be dynamically controlled by modifying the operation of any of pumps 120, 122, 124, 126. Further, without modifying the output of either of blender 100 or blender 102, the composition of treatment composition for well 150 may be modified by varying operation of one or more of pump 120 and pump 124, while the composition of treatment composition for well 152 may be modified by varying operation of one or more of pump 122 and pump 126.

Treatment compositions may be mixed in a variety of different locations within pumping system 170 of FIG. 1. Mixing of compositions from blenders 100, 102 to produce the first and second treatment compositions may occur at the wellhead or may occur before transport of fluid to the wellhead. In one or more embodiments, mixing of the first and second treatment compositions may occur in conduit prior to introduction into the well. In one or more embodiments, mixing may occur within the well. For example, the first composition may be injected into the well and the second composition may be injected into an annular region of the well such that mixing occurs near a stimulated zone.

Figure 2:
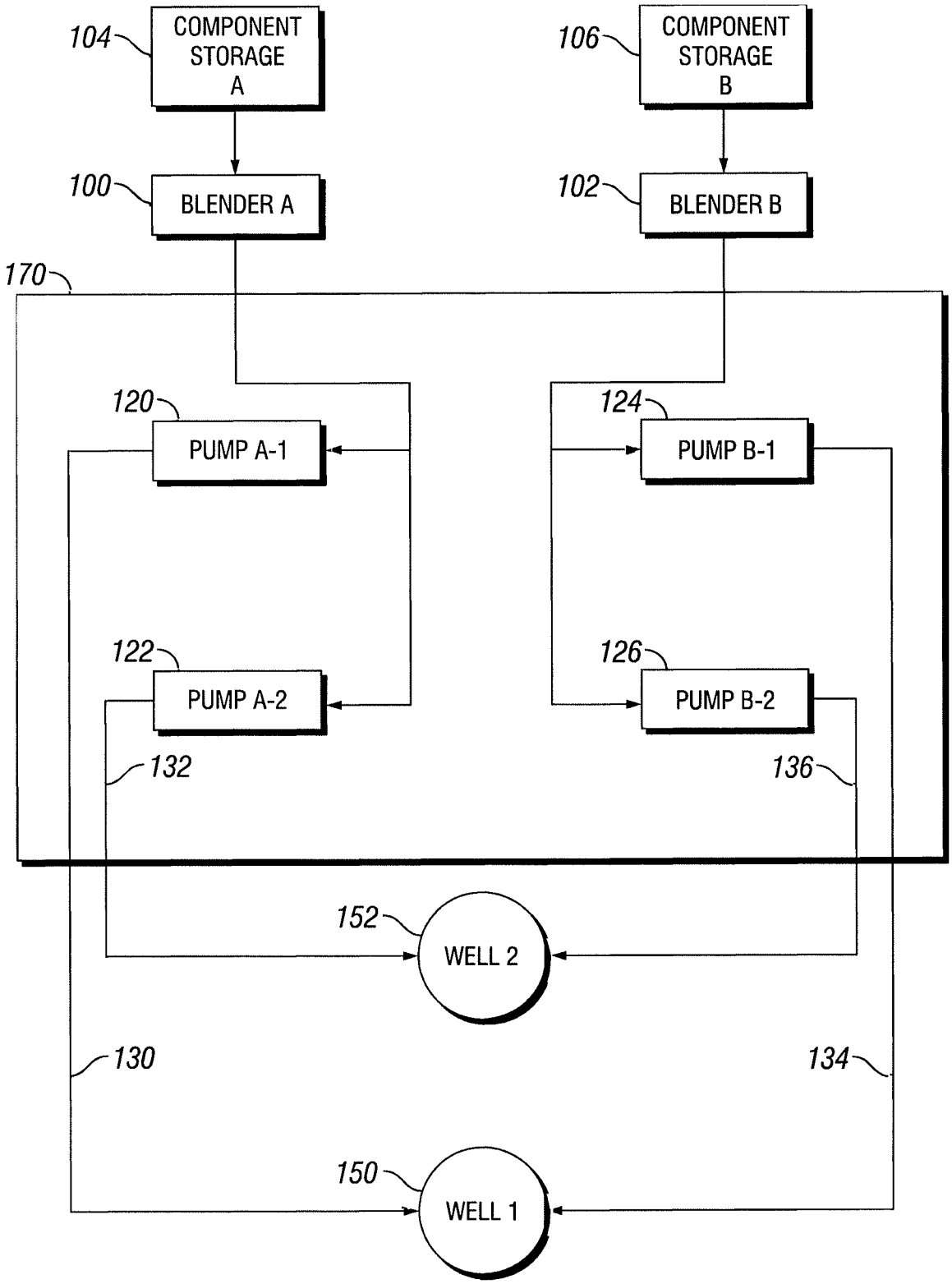
FIG. 2 illustrates a flow diagram of a centralized well treatment facility for treating multiple wells comprising a split flow pumping system configuration and multiple blenders.

FIG. 2 illustrates a flow diagram of a centralized well treatment facility comprising a split flow pumping system configuration for treating multiple wells using multiple blenders, where compositions delivered to the multiple wells are not combined prior to reaching the wellhead. A first composition from blender 100 is pumped via conduit 130 and 132 to wells 150 and 152, respectively, and a second composition from blender 102 is pumped via conduit 134 and 136 to wells 150 and 152, respectively. As illustrated in FIG. 2, the first and second compositions may be pumped into wells 150, 152 for combination into one or more treatment compositions within the well.

In one or more embodiments, the first and second treatment compositions may be substantially similar compositions. For example, the compositions of first and second treatment compositions may be substantially similar because the composition of the first composition is substantially similar to the composition of the second composition such that any combination of the first and second composition results in a treatment composition with the same composition as both the first composition and the second composition. In one or more embodiments, where the composition of the first composition differs from the composition of the second composition, the first treatment composition may be substantially similar to the second treatment composition if the ratio of first composition to second composition in the first treatment composition is substantially similar to the ratio of first composition to second composition in the second treatment composition.

It may be beneficial to treat multiple wells with similar treatment compositions using the split flow pumping system configuration in one or more situations. For example, the split flow pumping system configuration may be used with two or more similar treatment compositions when two or more wells require simultaneous and similar treatment and two or more blenders are required to produce sufficient treatment composition to treat the two or more wells. In another example, the split flow pumping system configuration of FIG. 1 may be beneficial in situations where, for example, two or more wells require simultaneous and similar treatment but production of treatment composition for the two or more wells requires preparation of one composition from a first blender and a second composition from a second blender. In yet another example, the split flow pumping system configuration may be beneficial when two or more wells may be treated with the same treatment composition, but each well requires, for example, different fluid pressures or flow rates for treatment because the delivery of treatment composition to each well is controlled by one or more independent pumps.

The first and second treatment compositions may be different compositions. For example, when the first composition differs from the second composition and a treatment composition is created by combining the first composition with the second composition, one may modify the composition of the treatment composition by varying the ratio of the first composition to the second composition. For example, a first treatment composition may be a combination of one part first composition to two parts second composition, while a second treatment composition may be a combination of two parts first composition to one part second composition. One way to vary the ratio of first composition to second composition in a treatment composition is by varying the flow rate of fluid discharged by a pump (for example, any one of pumps 120, 122, 220, 222). For example, a first treatment composition (comprising one part first composition to two parts second composition) may be created by combining a first composition and a second composition discharged by pumps 120, 124, respectively, where pump 120 discharges half the volume of composition discharged by pump 124. In another example, a second treatment composition (comprising two parts first composition to one part second composition) may be created by combining a first and a second composition discharged by pumps 122, 126, respectively, where pump 122 discharges twice the volume of composition discharged by pump 126.

One of ordinary skill in the art will recognize that the first and second compositions may comprise one or more components, including without limitation one or more gasses, one or more liquids, one or more solids, one or more polymers, and any other material. Further, one of ordinary skill in the art will recognize that the first composition and second composition may combine to create a continuum of treatment compositions. One of ordinary skill in the art will further recognize that, as described herein, treatment composition distributed to well 150 or well 152 via conduit 130 or conduit 134, respectively, may be distributed to one or more wells.

Figure 3:
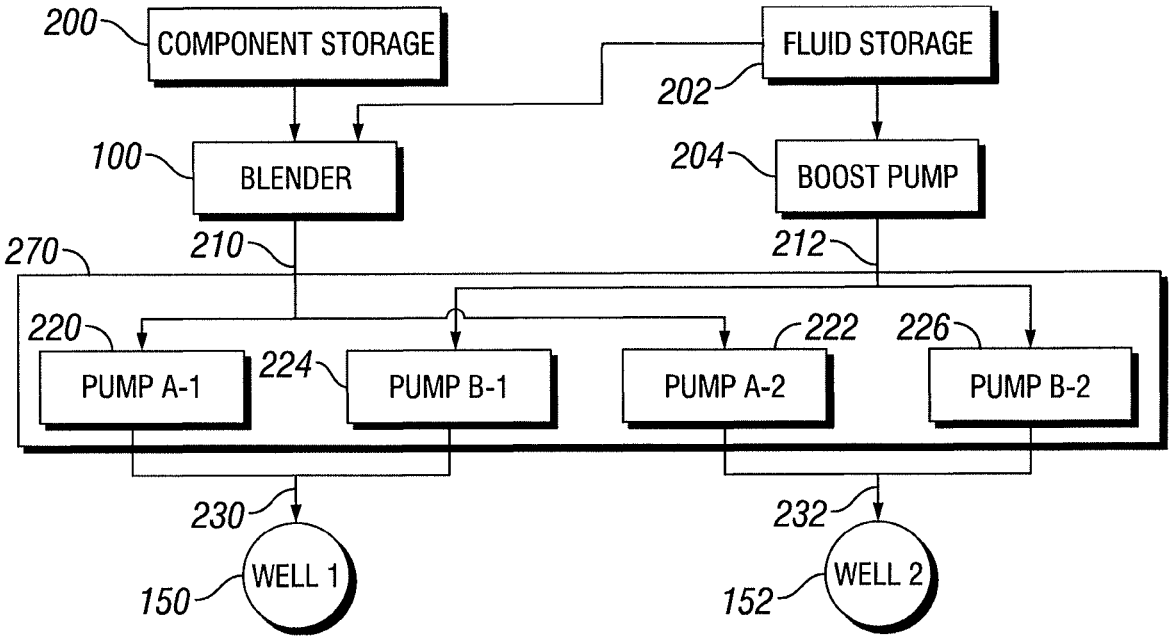
FIG. 3 illustrates a flow diagram of a centralized well treatment facility for treating multiple wells comprising a split flow pumping system configuration.

FIG. 3 illustrates a flow diagram of a centralized well treatment facility comprising a split flow pumping system configuration for treating multiple wells using a one or more blenders for production of a composition. In one or more embodiments, a split flow pumping system configuration may include a blending system comprising one or more blenders 100 for production of one or more compositions, a component storage system 200 comprising one or more components, a fluid storage system 202 comprising one or more fluids, a pumping system 270 for delivering treatment composition to wells 150, 152, and a power source (not shown). Blender 100 may combine one or more components from component storage system 200 with one or more fluids to produce a composition. Fluids used by blender 100 may optionally be provided from fluid storage 202. Conduit 210 may convey the composition to pumps 220, 222. Boost pump 204 may pump fluid in conduit 212 to pumps 224, 226. In one or more embodiments, blender 100 may further comprise a boost pump (not shown). The discharge of pump 220 and discharge of pump 224 may combine to create a first treatment composition that may be used to treat well 150, while the discharge of pump 222 and discharge of pump 226 may combine to create a second treatment composition that may be used to treat well 152. In an example embodiment, conduit 230, 232 may be a common suction header. As noted above, the first and second treatment compositions may be similar compositions if the ratio of composition and fluid are similar when combined to produce the first and second treatment compositions. The first and second treatment compositions may also be different compositions if the ratio of composition to fluid is not similar in the first and second treatment compositions. In one or more embodiments, the outputs of pumps 220 and 224 may combine prior to delivery to the well, for example, in conduit 230. In one or more embodiments, the outputs of pumps 220 and 224 may combine after delivery to the well 150. For example, a treatment composition may be created by the combination of composition from pump 220 and fluid from pump 224 within well 150 In one or more embodiments, the outputs of pumps 222 and 226 may combine after delivery to the well 152. For example, a treatment composition may be created by the combination of composition from pump 222 and fluid from pump 226 within well 152.

The well treatment facility configuration of FIG. 2 comprises two flow paths: (1) a flow path for conveying composition; and (2) a path for conveying fluids. In one or more embodiments, fluids pumped by boost pump 202 may comprise minimal solids or polymers. Unlike current configurations where the composition of treatment composition introduced into a well is determined at the blender, the configuration of FIG. 2 enables the compositions entering the well to be dynamically modified by modifying the flow rate of composition discharged by pumps 220, 222 and the flow rate of fluid discharged by pumps 224, 226. For example, the ratio of components in compositions or treatment compositions entering wells 150, 152 may be lowered by increasing the flow rate discharged by pumps 224, 226. Alternatively, the ratio of components in compositions or treatment composition entering wells 150, 152 may be increased by decreasing the flow rate discharged by pumps 224, 226. The composition of treatment composition entering a well may be similarly modified by altering the flow rate discharged by pumps 220, 222. It may be preferable to modify the flow rate discharged by pumps 224, 226 because modifying the flow rate discharged by pumps 220, 222 may place greater demands on blender 100 and require increased consumption of components from component storage 200. Such demands may be more difficult to facilitate than simply increasing the amount of fluid pumped from the fluid storage system 202.

As noted above, the compositions discharged by pumps 220, 222 may include one or more components, including without limitation one or more base fluids, one or more gasses, one or more liquids, one or more solids, and any combination thereof that may be used in accordance with the methods of the present disclosure. In one or more embodiments, pumps 220, 222 may intake and discharge compositions comprising solids, or abrasive or corrosive materials, such that these pumps may experience more wear and tear than pumps 224, 226, and may therefore require protective coatings that prevent and resist abrasion, erosion, and corrosion. In one or more embodiments, pumps 224, 226 may not be exposed to the same components and may not require protective coatings and may experience less wear and tear. Similarly, pumps may be replaced less frequently than pumps, resulting in lower costs and less down time. Accordingly, pumps may require less maintenance or may cost less than pumps, which may save costs and enable more efficient and effective operations.

In one or more embodiments, a split flow pumping system configuration may further comprise a local control system including one or more controllers, wherein each of the controllers may comprise one or more of hardware elements and software elements. Controllers may comprise consumer off-the-shelf (COTS) computer systems, including hardware and software. Controllers may further comprise specialized hardware and software. In one or more embodiments, controllers may comprise specialized hardware and software for communicating with one or more of sensors, pumps, blenders, component storage systems, fluid storage systems, valves, and other elements of the split flow pumping system configuration to monitor (including but not limited to detecting and recording data) and control (including but not limited to regulating, managing, and directing) one or more of the delivery of one or more compositions and one or more treatment compositions for treatment of one or more wells, either independently, simultaneously, or both. In one or more embodiments, controllers may automatically monitor and control the treatment of one or more wells based at least in part on one or more of a reservoir model, a hydraulic fracture model, and programmed fracturing stages. In one or more embodiments, controllers may display or otherwise notify users, including, for example, operations personnel including but not limited to an operator in a control van, regarding the controller's monitoring and controlling of one or more compositions and one or more treatment compositions for treating one or more wells. In one or more embodiment, controllers may receive one or more inputs from personnel to monitor and control one or more of the delivery of one or more compositions and one or more treatment compositions for treating of one or more wells, either independently, simultaneously, or both. One of ordinary skill in the art will further recognize that, as described herein, the one or more compositions and one or more treatment compositions distributed to well 150 or well 152 via conduit 230 or conduit 232, respectively, may be distributed to one or more wells. As noted herein, the combination of one or more compositions and/or one or more fluids to create the one or more treatment compositions may occur prior to delivery to wells 150, 152, at the surface of wells 150, 152, below ground level after the one or more compositions are pumped into wells 150, 152, and any combination thereof.

Figure 4:
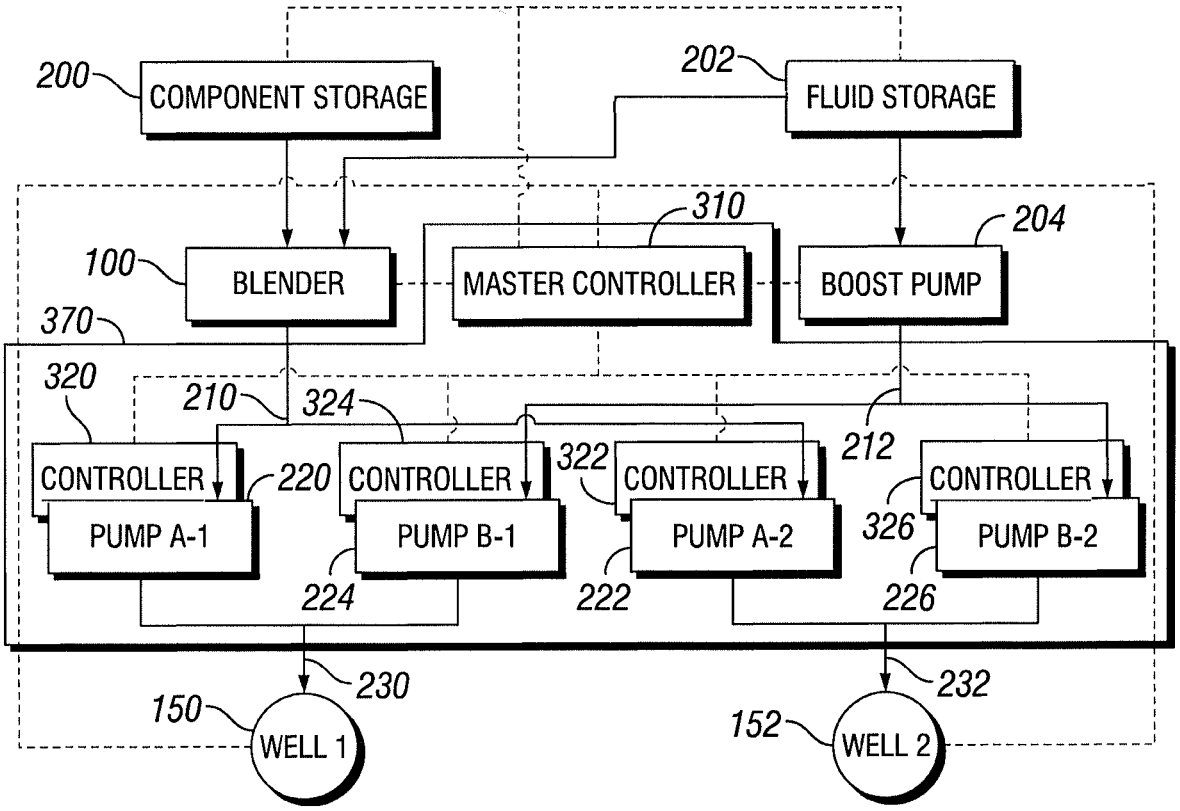
FIG. 4 illustrates a flow diagram of a centralized well treatment facility for treating multiple wells comprising a split flow pumping system configuration and local control system.

FIG. 4 illustrates a flow diagram of a centralized well treatment facility comprising a split flow pumping system configuration for treating multiple wells using a blender and a local control system. FIG. 3 illustrates blender 100, boost pump 204, and pumping system 370 comprising pumps 220, 222, and pumps 224, 226. FIG. 3 also illustrates the split flow pumping system configuration further comprising master controller 310, pump controllers 320, 322, 324, 326 (collectively, the controllers), and one or more sensors distributed throughout the pumping system for providing data to the controllers (not shown). In one or more embodiments, master controller 310 may coordinate some or all elements of the centralized well treatment facility, including without limitation one or more of monitoring and controlling other controllers, pumps, blenders, fluid storage, and component storage. Master controller 310 may monitor and communicate with one or more of pump controllers 320, 322 to control pumps 220, 222 and may monitor and communicate with one or more of pump controllers 324, 326 to control pumps 224, 226. As noted above, the controllers may comprise one or more ordinary computer systems, one or more specialized computer systems, and any combination thereof including hardware and software. In one or more embodiments, master controller 310 and controllers 320, 322, 324, 326 may be replaced by a distributed control system without a master controller in which each controller coordinates with all other controllers to coordinate the performance of the centralized well treatment facility.

Master controller 310 may be connected to and communicate with blender 100 and boost pump 204, as well as pump controllers 320, 322 and pump controllers 324, 326 (shown by dashed lines). In one or more embodiments, master controller 310 may monitor and control one or more of the types and concentration of components introduced into blender 100 to produce one or more compositions, as well as the component concentration and flow rate of composition from the blender. In one or more embodiments, master controller 310 may also monitor and control one or more of the types, flow rates, pressure, and output power of fluids pumped by boost pump 204. In one or more embodiments, master controller 310 may control valving and pumping systems, and other systems related to the boost pump. In one or more embodiments, master controller 310 may one or more of monitor and control component storage and fluid storage systems to ensure sufficient component material and fluids are available for blender 100 and boost pump 204. More specifically, master controller 310 may increase, maintain, or decrease the rate of introduction of components to component storage system 200 to regulate the amount and types of components available to blender 100, or may increase or decrease fluid flow rates from fluid storage 202 or components' rates from component storage 200 to maintain the ratio of components and fluid in composition produced by blender 100 and pumped by boost pump 204. Further, the controllers may monitor and control the mixing of compositions to control the production of one or more treatment compositions based on data from one or more pumps, sensors, and other elements of the split flow pumping system configuration.

One or more pump controllers 320, 322 may interact with sensors associated with pumps 220, 222, and one or more pump controllers 324, 326 may interact with sensors associated with one or more pumps 224, 226. Sensors may be integrated into one or more pumps or may be separate devices. In one or more embodiments, sensors may provide data including but not limited to the injection pressure, injection rate, flow rate, composition, temperature, and density of treatment composition of fluid discharged by a pump. pump controllers 320, 322, and pump controllers 324, 326 may monitor sensor data from pumps 220, 222 and pumps 224, 226, respectively. Pump controllers 320, 322, and pump controllers 324, 326 may also control pumps 220, 222 and pumps 224, 226, respectively, based at least in part on the monitored sensor data and may communicate sensor data and control data to master controller 310. Similarly, master controller 310 may monitor sensor data provided by controllers 320, 322, 324, 326, and may provide instructions to controllers 320, 322, 324, 326 based at least in part on sensor data and control data to control one or more of the injection pressure, injection rate, flow rate, and composition of treatment composition handled by pumps 220, 222 and pumps 224, 226. Master controller 310 may also monitor one or more of the time rate of change and integrated value of sensor data and control parameters.

Master controller 310 may monitor and control the treatment of multiple wells based at least in part on sensor feedback to provide individualized treatment to each of the multiple wells. Each pair of pumps of FIG. 3 (for example, pump 220 and pump 224, or pump 222 and pump 226) may be used to modify the composition of treatment composition introduced to a particular well (for example, well 150 and well 152, respectively) by modifying the flow rate of composition and fluid discharged by the respective pumps. In one or more embodiments, pump 220 and pump 224 may be used to modify the composition, flow rate, or pressure of one or more compositions and one or more treatment compositions for treatment of well 150, and pump 222 and pump 226 may be used to modify the composition, flow rate, or pressure of one or more compositions and one or more treatment compositions for treatment of well 152.

In some circumstances, it may be desirable for the master controller to maintain a consistent rate of component material entering a well. If the master controller receives sensor data indicating a decrease in the components' concentration in a composition produced by the blender, the master controller may communicate with a pump controller to increase the flow rate discharged by pumps to maintain the rate of component material entering the well. In response to the increase in the flow rate discharged by the pumps, the master controller may also communicate with a pump controller to decrease the rate of flow discharged by the corresponding pump to maintain a desired injection pressure.

In other circumstances, it may be desirable for the master controller to maintain a desired injection rate for treatment of a well. If the master controller receives sensor data indicating the blender is unable to produce sufficient composition to support the pumps such that a desired injection rate is maintained for the well, the master controller may decrease the injection rate of treatment composition delivered to that well by communicating with a pump controller to reduce the flow rate discharged by the associated pump. To offset the reduced flow rate discharged by the pump, the master controller may increase the injection rate of treatment composition received by that well by communicating with a pump controller to increase the flow rate discharged by the associated pump. Accordingly, the master controller may monitor and control one or more of the blending and pumping systems of the split flow pumping system configuration to maintain a consistent injection pressure or maintain a consistent rate of components introduced into a well.

In one or more embodiments, it may be desirable for the master controller to maintain a desired injection rate for one well while simultaneously maintaining the rate of components introduced to a second well. The master controller may be responsible for coordinating multiple systems throughout the split flow pumping system configuration to enable these and other goals. Accordingly, the master controller may enable independent and simultaneous treatment of multiple wells A benefit of the split flow pumping system configuration is simplified modification of the rate of components introduced into one or more wells. In one or more embodiments, the split flow pumping system configuration enables dynamic changes in components' concentration on a well-by-well basis without modifying the concentration of components in a composition produced by the blender. In an example embodiment, master controller 310 may decrease the rate of flow at pump 224 while increasing the rate of flow at pump 220 to significantly increase the concentration of components down well 150. Simultaneously, master controller may increase the rate of flow at pump 226 while decreasing the rate of flow at pump 222 to significantly decrease the concentration of components down well 152. Based on data from one or more sensors, the master controller may independently alter these settings to increase the rate of flow of treatment composition for treatment of well 150 and increase the concentration of components discharged to well 152. Treatment of wells 150, 152 may occur simultaneously but may be individualized to improve the effectiveness and efficiency of use of hydraulic fracturing equipment and personnel.

Master controller 310 may control blender 100 and boost pump 204 based at least in part on one or more of the pressures, flow rates, injection rates, compositions, temperatures, and densities of treatment composition required to treat wells 150, 152. For example, master controller 310 may instruct blender 100 to increase the rate of composition created or to increase the ratio of components in the composition when one or more of additional composition and increased concentration of components is required for treatment of two or more wells. Alternatively, master controller 310 may instruct boost pump 204 to increase the rate of flow of fluid pumped to ensure a constant rate of flow to pumps 224, 226 for pumping to two or more wells. In one or more embodiments, master controller 310 may account for or avoid significant changes to the flow rate of pumps 220, 222 to avoid surge loading of blender 100. In one or more embodiments, master controller 310 may monitor and provide notifications to personnel when one or more sensors indicate significant wear and tear to equipment to ensure equipment is replaced before significant reduction in performance of said equipment occurs.

In one or more embodiments, one or more components of the split flow pumping system configuration described herein may be mounted on a vehicle or trailer, or may be configured for ground deployment. In one or more embodiments, a trailer may comprise one or more elements of the split flow pumping system configuration, including one or more sensors, pumps, blenders, component storage systems, fluid storage systems, valves, and any other elements comprising the centralized well treatment facility. In other embodiments, the one or more sensors, pumps, blenders, component storage systems, fluid storage systems, valves, and any other elements comprising the centralized well treatment facility may be distributed across many trailers. For example, a single blender may provide composition to two or more auxiliary pump tractors (APT). In one or more embodiments, each APT may supplement one or more of the blender and boost pump as needed for higher flow rates. Further, each APT may enable customization of additives to one or more flow paths. Vehicle-mounted configurations may be beneficial if equipment needs to be quickly replaced as it enables other vehicles to quickly replace worn or damaged equipment.

In one or more embodiments, a first blender may provide a first composition to a first APT, while a second blender may simultaneously provide a second composition to a second APT. In an example embodiment, the first APT may comprise pumps 120, 122 of FIG. 1 while the second APT comprises pumps 124, 126 of FIG. 1. The first APT and the second APT may be used to simultaneously treat two or more wells by producing two or more treatment compositions by varying the ratio of the first composition to the second composition.

In one or more embodiments, each APT may comprise one or more pumps, where a single APT is configured to treat one or more wells. In one or more embodiments, the first APT may comprise pumps 220, 224 of FIGS. 3-4 and the second APT may comprise pumps 222, 226 of FIGS. 3-4. In one or more embodiments, one APT may comprise certain pumps (for example, pumps 224, 226 of FIGS. 3-4) while another APT may comprise other pumps (for example, pumps 220, 222 of FIGS. 3-4), such that the APT comprising certain pumps may be more easily replaced. This configuration may be beneficial in the event that certain pumps wear significantly during well treatment.

Each element depicted in the system may comprise one or more of each element. For example, each pump described herein may comprise one or more pumps, each blender may comprise one or more blenders, and the storage systems may comprise one or more tanks and containers for storing material as well as systems for distributing and receiving additional storage material. Further, as described herein, a blender or blending system may further comprise one or more boost pumps. Additionally, the power source of the split flow pumping system may comprise one or more power sources, wherein the power sources may comprise electric sources, gas sources, diesel sources, natural gas sources, and any combination thereof.

As described herein, computers may comprise any suitable machine or network of machines capable of communicating with other network equipped devices including without limitation on-site equipment, notification devices, control devices, network devices, storage devices, and resources. Computers may comprise a processor or central processing unit configured for executing instructions, program instructions, process data, or any combination thereof. The processor may be configured to interpret and execute program instructions, software, or other data retrieved and stored in memory, including without limitation read-only memory (ROM), random access memory (RAM), solid state memory, or disk-based memory.

Modifications, additions, or omissions may be made to computers without departing from the scope of the present disclosure. Any suitable configurations of components may be used. For example, components of computers may be implemented either as physical or logical components. Furthermore, in one or more embodiments, functionality associated with computers may be implemented in special purpose circuits or components. In one or more embodiments, functionality associated with components of computers may be implemented in configurable general-purpose circuit or components, such as configured computer program instructions.

In any embodiment, computers may include a non-transitory computer readable medium that stores one or more instructions where the one or more instructions when executed cause the processor to perform certain actions. As used herein, a computer may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes.

While the present disclosure has been described in connection with one or more embodiments, it will be understood by those skilled in the art that it is not intended to limit the disclosure to those embodiments. It is therefore contemplated that various alternative embodiments and modifications may be made to the disclosed embodiments without departing from the spirit and scope of the disclosure defined by the appended claims and equivalents thereof. In particular, with regards to the methods disclosed, one or more steps may not be required in all embodiments of the methods and the steps disclosed in the methods may be performed in a different order than was described. The indefinite articles "a" or "an," as used in the claims, are defined herein to mean one or more than one of the element that that a particular article introduces; and subsequent use of the definite article "the" is not intended to negate that meaning. Further, embodiments described herein involving two elements contemplate applications involving two or more of the same element. For example, discussions herein regarding treatment of two wells contemplate the treatment of three or more wells. Similarly, a pump illustrated in FIGS. 1-3 may comprise one or more pumps and a boost pump may comprise one or more boost pumps.

The invention claimed is:

1. A system, comprising:

a component storage system comprising one or more components;

a blending system that produces a first composition comprising the one or more components and a second composition comprising the one or more components; and a pumping system comprising a first one or more pumps, a second one or more pumps, a third one or more pumps, and a fourth one or more pumps, wherein the first composition is pumped to a first one or more wells by the first one or more pumps, wherein the first composition is pumped to a second one or more wells by the second one or more pumps, wherein the second composition is pumped to the first one or more wells by the third one or more pumps, and wherein the second composition is pumped to the second one or more wells by the fourth one or more pumps.

2. The system of claim 1, wherein the blending system further comprises a first one or more blenders for producing the first composition and a second one or more blenders for producing the second composition.

3. The system of claim 1, further comprising one or more sensors for sensing one or more pressures, flow rates, injection rates, compositions, temperatures, and densities of at least one of the first composition and the second composition.

4. The system of claim 1, further comprising a controller for controlling one or more pressures, flow rates, injection rates, compositions, temperatures, and densities of at least one of the first composition and the second composition.

5. The system of claim 4, further comprising one or more sensors for collecting data corresponding to the one or more pressures, flow rates, injection rates, compositions, temperatures, and densities of at least one of the first composition and the second composition, wherein the controller controls the one or more pressures, flow rates, injection rates, compositions, temperatures, and densities of at least one of the first composition and the second composition based, at least in part, on the data.

6. The system of claim 1, wherein the first composition combines with the second composition to create a first treatment composition for treatment of the first one or more wells, and wherein the first composition combines with the second composition to create a second treatment composition for treatment of the second one or more wells.

7. The system of claim 6, wherein the first treatment composition is created at one or more of the surface of the first one or more wells and below ground level in the first one or more wells, and wherein the second treatment composition is created at one or more of the surface of the second one or more wells and below ground level in the second one or more wells.

8. The system of claim 6, wherein the pumping system simultaneously treats the first one or more wells with the first treatment composition and treats the second one or more wells with the second treatment composition.

9. The system of claim 6, wherein at least one of the first composition has a different composition than the second composition and the first treatment composition has a different composition than the second treatment composition.

10. A system, comprising:

a blending system for producing a first composition;

a boost pump for pumping a second composition; and a pumping system comprising a first one or more pumps, a second one or more pumps, a third one or more pumps, and a fourth one or more pumps, wherein the first composition is pumped to a first one or more wells by the first one or more pumps, wherein the first composition is pumped to a second one or more wells by the second one or more pumps, wherein the second composition is pumped to the first one or more wells by the third one or more pumps, and wherein the second composition is pumped to the second one or more wells by the fourth one or more pumps.

11. The system of claim 10, further comprising one or more sensors for sensing one or more pressures, flow rates, injection rates, compositions, temperatures, and densities of at least one of the first composition and the second composition.

12. The system of claim 10, further comprising a controller for controlling one or more pressures, flow rates, injection rates, compositions, temperatures, and densities of at least one of the first composition and the second composition.

13. The system of claim 12, further comprising one or more sensors for collecting data corresponding to the one or more pressures, flow rates, injection rates, compositions, temperatures, and densities of at least one of the first composition and the second composition, and wherein the controller controls the one or more pressures, flow rates, injection rates, compositions, temperatures, and densities of at least one of the first composition and the second composition based, at least in part, on the data.

14. The system of claim 10, wherein the first composition combines with the second composition to create a first treatment composition for treatment of the first one or more wells, and wherein the first composition combines with the second composition to create a second treatment composition for treatment of the second one or more wells.

15. The system of claim 14, wherein the first treatment composition is created at one or more of the surface of the first one or more wells and below ground level in the first one or more wells, and wherein the second treatment composition is created at one or more of the surface of the second one or more wells and below ground level in the second one or more wells.

16. The system of claim 14, wherein the pumping system simultaneously treats the first one or more wells with the first treatment composition and treats the second one or more wells with the second treatment composition.

17. The system of claim 14, wherein at least one of the first composition has a different composition than the second composition and the first treatment composition has a different composition than the second treatment composition.

18. A method for treating two or more wells comprising:

operating a first one or more pumps to pump a first composition;

operating a second one or more pumps to pump the first composition;

operating a third one or more pumps to pump a second composition;

operating a fourth one or more pumps to pump the second composition;

combining the first composition and the second composition to create a first treatment composition;

combining the first composition and the second composition to create a second treatment composition;

treating a first one or more wells with the first treatment composition; and treating a second one or more wells with the second treatment composition.

19. The method of claim 18, wherein the first treatment composition differs from the second treatment composition.

20. The method of claim 18, further comprising modifying the composition of at least one of the first treatment composition and the second treatment composition by modifying operation of at least one of the first one or more pumps, the second one or more pumps, the third one or more pumps, and the fourth one or more pumps.

* * * * *